US009634397B2

(12) United States Patent
Lee et al.

(10) Patent No.: US 9,634,397 B2
(45) **Date of Patent: *Apr. 25, 2017**

(54) ULTRA-WIDEBAND TAPERED SLOT ANTENNA

(71) Applicant: ELECTRONICS AND TELECOMMUNICATIONS RESEARCH INSTITUTE, Daejeon (KR)

(72) Inventors: Dae Heon Lee, Daejeon (KR); Hae Yong Yang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 210 days.

This patent is subject to a terminal disclaimer.

(21) Appl. No.: 14/550,931

(22) Filed: Nov. 22, 2014

(65) Prior Publication Data

US 2015/0364827 A1 Dec. 17, 2015

(30) Foreign Application Priority Data

Jun. 11, 2014 (KR) ..... 10-2014-0070499

(51) Int. Cl.
*H01Q 13/10* (2006.01)
*H01Q 13/08* (2006.01)

(52) U.S. Cl.
CPC ..... *H01Q 13/085* (2013.01)

(58) Field of Classification Search
CPC ..... H01Q 1/50; H01Q 13/085
(Continued)

(56) References Cited

U.S. PATENT DOCUMENTS 4,843,403 A 6/1989 Lalezari et al.
5,081,466 A 1/1992 Bitter, Jr.
(Continued)

FOREIGN PATENT DOCUMENTS

KR 10-2007-0058852 A 6/2007
KR 10-1116851 B1 3/2012
KR 10-1394479 B1 5/2014

OTHER PUBLICATIONS

I.-J. Yoon et al., "Ultra-wideband tapered slot antenna with band cutoff characteristic," Electronics Letters, May 2005, vol. 41, No. 11.

*Primary Examiner* — Huedung Mancuso
(74) *Attorney, Agent, or Firm* — LRK Patent Law Firm

(57) ABSTRACT

An ultra-wideband tapered slot antenna that is capable of providing spatial independent band-stop characteristics which are irrelevant to the radiation direction of the antenna in a dual-stop band. The antenna includes an ultra-wideband tapered slot antenna includes a radiating unit formed on a first surface of a substrate and configured to radiate radio signals. A feeding unit is formed on a second surface of the substrate and is configured to provide the radio signals to the radiating unit. Separate stubs are formed to be spaced apart from the feeding unit around the feeding unit and are configured to reject frequencies in a first stop band from the radio signals radiated from the radiating unit. A slot is formed in a stub formed at a first end of the feeding unit and is configured to reject frequencies in a second stop band from the radio signals.

13 Claims, 17 Drawing Sheets

(58) Field of Classification Search
USPC ..... 343/767, 860
See application file for complete search history.

(56) References Cited

U.S. PATENT DOCUMENTS

| | | | | |
|---|---|---|---|---|
| 5,519,408 | A | 5/1996 | Schnetzer | |
| 8,237,614 | B2 * | 8/2012 | Kuramoto | H01Q 1/2208 343/700 MS |
| 8,279,128 | B2 * | 10/2012 | McQuaid | H01Q 1/38 343/700 MS |
| 8,912,968 | B2 * | 12/2014 | Sharma | H01Q 9/0421 343/700 MS |
| 8,994,609 | B2 * | 3/2015 | Gregoire | H01Q 13/26 343/700 MS |
| 9,142,889 | B2 * | 9/2015 | Pazin | H01P 5/028 |
| 2014/0139394 | A1 | 5/2014 | Lee et al. | |

* cited by examiner 3.1 GHz 3.5 GHz 5.5 GHz

9 GHz

ULTRA-WIDEBAND TAPERED SLOT ANTENNA

CROSS REFERENCE TO RELATED APPLICATION

This application claims the benefit of Korean Patent Application No. 10-2014-0070499, filed Jun. 11, 2014, which is hereby incorporated by reference in its entirety into this application.

BACKGROUND OF THE INVENTION

1. Technical Field

The present invention relates generally to an ultra-wideband tapered slot antenna and, more particularly, to an ultra-wideband tapered slot antenna in which C-shaped stubs and a spiral slot are formed in the feed line of the antenna, thus implementing band-stop characteristics in dual bands (e.g., 3.5/5.5 GHz bands).

2. Description of the Related Art

Thanks to the advantages of low power, low cost, and high-speed data transmission, it is expected that ultra-wideband (UWB) systems will be widely applied to the fields of a next-generation Wireless Personal Area Network (WPAN), such as a wireless home network, and a short-range radar system.

However, a frequency band allocated to UWB systems is a 3.1 to 10.6 GHz band, and overlaps the World interoperability for Microwave Access (WiMAX) frequency band for IEEE 802.16 which is operated in a 3.3 to 3.7 GHz band and a Wireless Local Area Network (WLAN) frequency band for IEEE 802.11a which is operated in a 5.15 to 5.825 GHz band. Therefore, in order to solve the problem of electromagnetic interference (EMI) between the UWB system, a 3.5 GHz WiMAX system, and a 5.5 GHz WLAN system, a UWB antenna having a dual-band stop (rejection) function is required.

As antennas for UWB systems, a tapered slot antenna, a bow-tie antenna, a discone antenna, a monopole antenna, etc. are known. In particular, a Tapered Slot Antenna (TSA), which is a directional antenna, has been widely applied to the field of short-range radar systems. Related preceding technologies such as U.S. Pat. Nos. 4,843,403, 5,081,466, and 5,519,408 disclose various types of ultra-wideband tapered slot antennas. However, these conventional antennas are problematic in that they do not have a band-stop function.

As other preceding technologies, Korean Patent No. 10-1116851 and Korean Patent Application Publication No. 10-2007-0058852 disclose an ultra-wideband antenna having a band-stop function. In the above patents, ultra-wideband monopole antennas in which various slots such as U- or V-shaped slots are formed in a radiating element and which are capable of rejecting an undesired frequency band have been widely proposed. However, conventional UWB monopole antennas having a band-stop function are disadvantageous in that, since slots are arranged in a radiating element, the distortion of a radiation pattern in a stop band is caused.

SUMMARY OF THE INVENTION

Accordingly, the present invention has been made keeping in mind the above problems occurring in the prior art, and an object of the present invention is to provide an ultra-wideband tapered slot antenna that is capable of providing band-stop characteristics which are irrelevant to the radiation direction (spatial independent) of the antenna in a dual-stop band by forming C-shaped stubs and a spiral slot in a feeding element other than the radiating element of the ultra-wideband tapered slot antenna.

In accordance with an aspect of the present invention to accomplish the above object, there is provided an ultra-wideband tapered slot antenna, including a radiating unit formed on a first surface of a substrate and configured to radiate radio signals; a feeding unit formed on a second surface of the substrate and configured to provide the radio signals to the radiating unit; separate stubs formed to be spaced apart from the feeding unit around the feeding unit and configured to reject frequencies in a first stop band from the radio signals radiated from the radiating unit; and a slot formed in a stub formed at a first end of the feeding unit and configured to reject frequencies in a second stop band from the radio signals radiated from the radiating unit.

The feeding unit may include a microstrip line, and the separate stubs may include a first C-shaped stub and a second C-shaped stub formed at symmetrical locations with respect to the microstrip line.

The first C-shaped stub and the second C-shaped stub may have a length that is ½ of a wavelength of a center frequency signal of the first stop band.

The center frequency of the first stop band may be controlled by adjusting the length of the first C-shaped stub and the second C-shaped stub.

The center frequency of the first stop band may be lowered if the length of the first C-shaped stub and the second C-shaped stub is increased.

The slot may be formed in a spiral shape.

The slot may have length that is ½ of a wavelength of a center frequency signal of the second stop band.

The center frequency of the second stop band may be controlled by adjusting the length of the slot.

The center frequency of the second stop band may be lowered if the length of the slot is increased.

The radiating unit may have a tapered slot.

The first stop band may be a 3.5 GHz band.

The second stop band may be a 5.5 GHz band.

In accordance with another aspect of the present invention to accomplish the above object, there is provided an ultra-wideband tapered slot antenna, including a dielectric substrate; C-shaped first and second separate stubs formed around a feed line on a second surface of the dielectric substrate opposite to a radiating unit formed on a first surface of the dielectric substrate the feed line so that the C-shaped first and second separate stubs are spaced apart from the feed line, the C-shaped first and second separate stubs rejecting frequencies in a first stop band from radio signals radiated from the radiating unit; and a spiral slot formed at an end of the feed line and configured to reject frequencies in a second stop band from the radio signals radiated from the radiating unit, wherein the first separate stub and the second separate stub have a length that is ½ of a wavelength of a center frequency signal of the first stop band, and wherein the slot has a length that is ½ of a wavelength of a center frequency signal of the second stop band.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
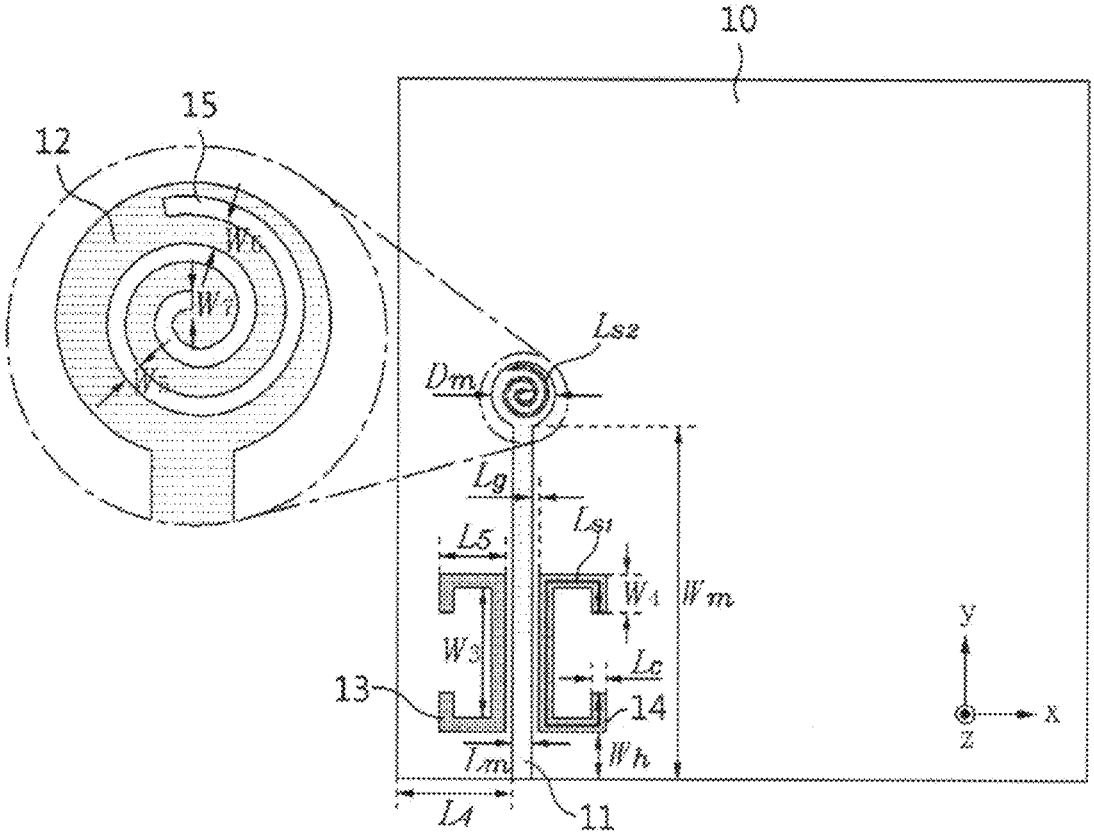
FIG. 1 is a bottom view showing an ultra-wideband tapered slot antenna according to an embodiment of the present invention.

The present invention may be variously changed and may have various embodiments, and specific embodiments will be described in detail below with reference to the attached drawings.

However, it should be understood that those embodiments are not intended to limit the present invention to specific disclosure forms and they include all changes, equivalents or modifications included in the spirit and scope of the present invention.

The terms used in the present specification are merely used to describe specific embodiments and are not intended to limit the present invention. A singular expression includes a plural expression unless a description to the contrary is specifically pointed out in context. In the present specification, it should be understood that the terms such as "include" or "have" are merely intended to indicate that features, numbers, steps, operations, components, parts, or combinations thereof are present, and are not intended to exclude a possibility that one or more other features, numbers, steps, operations, components, parts, or combinations thereof will be present or added.

Unless differently defined, all terms used here including technical or scientific terms have the same meanings as the terms generally understood by those skilled in the art to which the present invention pertains. The terms identical to those defined in generally used dictionaries should be interpreted as having meanings identical to contextual meanings of the related art, and are not interpreted as being ideal or excessively formal meanings unless they are definitely defined in the present specification.

Embodiments of the present invention will be described in detail with reference to the accompanying drawings. In the following description of the present invention, the same reference numerals are used to designate the same or similar elements throughout the drawings and repeated descriptions of the same components will be omitted.

Figure 2:
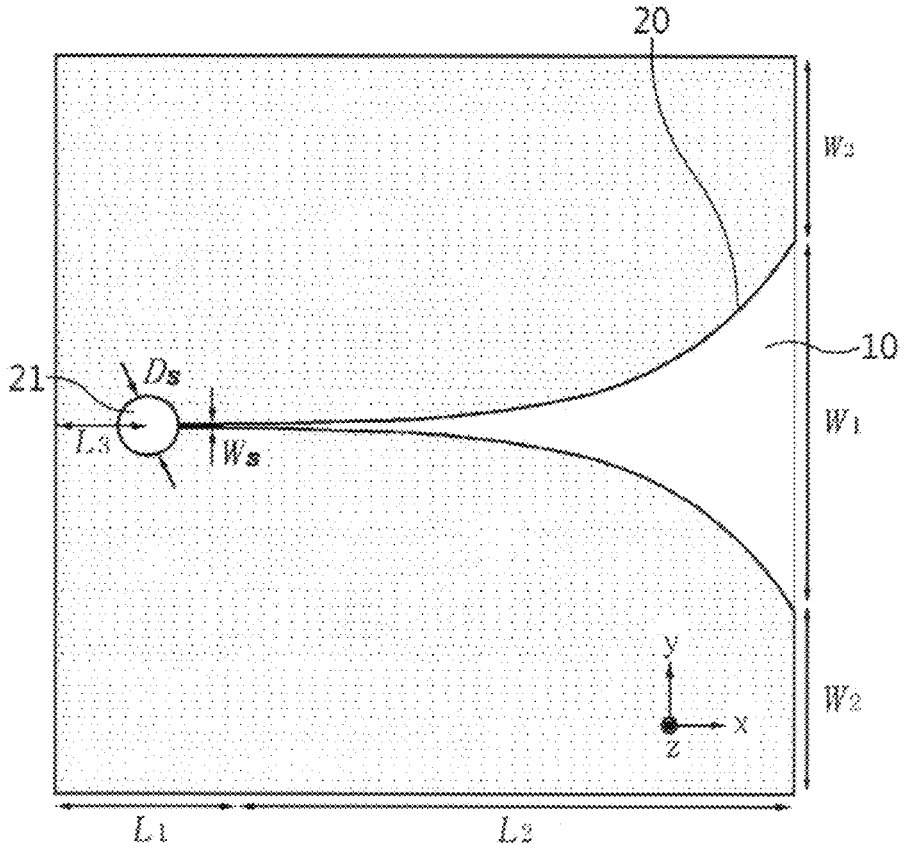
FIG. 2 is a top view showing an ultra-wideband tapered slot antenna according to an embodiment of the present invention.
Figure 3:
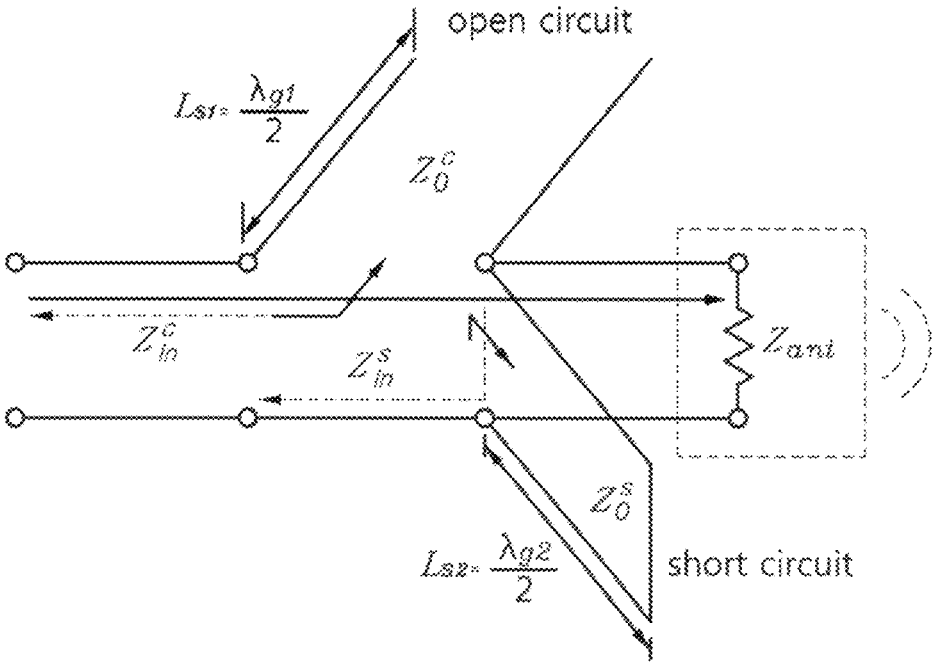
FIG. 3 is an equivalent diagram of FIGS. 1 and 2.

FIG. 1 is a bottom view showing an ultra-wideband tapered slot antenna according to an embodiment of the present invention, FIG. 2 is a top view showing an ultra-wideband tapered slot antenna according to an embodiment of the present invention, and FIG. 3 is an equivalent diagram of FIGS. 1 and 2.

An ultra-wideband tapered slot antenna according to an embodiment of the present invention is almost identical to a conventional tapered slot antenna (TSA).

However, there is a difference in that, for a band-stop function, a first C-shaped stub 13 and a second C-shaped stub 14 spaced apart from a feeding unit 11 by a predetermined interval, and a spiral slot 15 formed in a microstrip circular stub 12, are added to the conventional TSA. Here, the feeding unit 11 may be regarded as a feeding line. The first C-shaped stub 13 and the second C-shaped stub 14 may be examples of separate stubs described in the accompanying claims of the present invention.

The ultra-wideband tapered slot antenna according to the embodiment of the present invention may be implemented using a flame retardant 4 (FR4) substrate 10 having a thickness of 0.8 mm and having a relative dielectric constant of 4.4, and identified dimensions of parameters are given by the following Table 1.

TABLE 1

| Parameter | Value [mm] | Parameter | Value [mm] |
|---|---|---|---|
| $W_1$ | 25.2 | $D_m$ | 4.8 |
| $W_2$ | 12.4 | $D_s$ | 4 |
| $L_1$ | 8.5 | $W_s$ | 0.16 |
| $L_2$ | 41.5 | $W_3$ | 9.6 |
| $W_m$ | 25.11 | $W_4$ | 3.2 |
| $L_m$ | 1.46 | $L_3$ | 6.2 |
| $L_4$ | 8.22 | $L_5$ | 5.7 |
| $L_g$ | 0.3 | $L_c$ | 1.2 |
| $W_h$ | 3 | $W_5$ | 0.3 |
| $W_6$ | 0.5 | $W_7$ | 0.25 |
| $L_{s1}$ | 25.7 | $L_{s2}$ | 14.9 |

The ultra-wideband tapered slot antenna according to the embodiment of the present invention includes a substrate 10, a feeding unit 11, a microstrip circular stub 12, a first C-shaped stub 13, a second C-shaped stub 14, a radiating unit 20, and a microstrip slot line transition unit.

The substrate 10 may be made of a dielectric (e.g., an FR4 material) having a thickness of about 0.8 mm and a relative dielectric constant of about 4.4.

The feeding unit 11 is formed on the bottom surface of the substrate 10 to provide radio signals. The feeding unit 11 includes, for example, a microstrip line of about 50Ω.

The microstrip circular stub 12 is formed at one end of the feeding unit 11.

The radiating unit 20 is formed on the top surface of the substrate 10 to radiate radio signals. The radiating unit 20 may be formed, for example, in the shape of a horn.

In the radiating unit 20, a hole 21 is formed to be spaced apart from one end of the radiating unit 20 by a predetermined distance (by a distance of about $L_3$). That is, the hole 21 may be understood to be formed only in the radiating unit 20. A narrow slot is formed in a portion of the hole 21. Here, the narrow slot is formed to have a width of about $W_s$ in the portion of the hole 21 and have a width gradually increasing in a direction from the hole 21 to the other end of the radiating unit 20. Therefore, the slot has a widened shape having a width of about $W_1$ (that is, a rounded (tapered) shape such as that of a horn) at the other end of the radiating unit 20. In this way, the hole 21 and the narrow slot formed in the portion of the hole 21 may be collectively called a slotline transition unit. Further, the microstrip circular stub 12, the hole 21, and the narrow slot formed in the portion of the hole 21 may be collectively called a microstrip-slotline transition unit. The microstrip-slotline transition unit connects the feeding unit 11 to the radiating unit 20.

In this regard, the microstrip circular stub 12 of the feeding unit 11 and the slotline transition unit have frequency-independent transfer characteristics, and thus ultra-wideband radio signals may be transferred from the feeding unit 11 to the radiating unit 20.

In particular, in an embodiment of the present invention, a first C-shaped stub 13 and a second C-shaped stub 14 which are spaced apart from the microstrip line of the feeding unit 11 by a predetermined interval $L_g$ and which have a length of $L_{s1}$ are formed so as to reject signals in a 3.5 GHz frequency band. In this case, the C-shaped stubs 13 and 14 are characterized in that they have a length that is ½ of the wavelength $\lambda_{g1}$ of the center frequency signal of a band desired to be rejected.

The C-shaped stubs 13 and 14 function to resonate and prevent frequency signals desired to be rejected from being transferred from the feeding unit 11 to the radiating unit 20. Referring to the equivalent circuit diagram of FIG. 3, the input impedance $Z_{in}^C$ of the C-shaped stubs 13 and 14 may be represented by the following Equation (1):

$$Z_{in}^C = -jZ_O^C \cot \beta_C L_{s1} \quad (1)$$

where $Z_{in}^C$ denotes the input impedance of the C-shaped stubs 13 and 14, $Z_O^C$ denotes the characteristic impedance of the C-shaped stubs 13 and 14, $L_{s1}$ denotes the length of the C-shaped stubs 13 and 14, $\beta_c$ denotes the propagation constant of the C-shaped stubs 13 and 14, $\beta_{g1}$ denotes the guide wavelength of the C-shaped stubs 13 and 14, and $Z_{am}$ denotes the radiation impedance of the antenna.

Therefore, when the length $L_{s1}$ of the C-shaped stubs 13 and 14 becomes the half wavelength of stop-band frequencies ($L_{s1}=\lambda_{g1}/2$), the input impedance $Z_{in}^C$ of the C-shaped stubs 13 and 14 becomes infinite and then the C-shaped stubs are opened ($\beta_c=2\pi/\lambda_{g1}$). That is, the signals corresponding to stop-band frequencies are stopped by the C-shaped stubs 13 and 14. Accordingly, in an embodiment of the present invention, it is most preferable that the length of the C-shaped stubs 13 and 14 be ½ of the center wavelength of the stop band desired to be rejected.

Furthermore, in an embodiment of the present invention, a spiral slot 15 having a length of $L_{s2}$ is formed in the microstrip circular stub 12 so as to reject signals in a 5.5 GHz frequency band. At that time, the spiral slot 15 is characterized in that it has a length corresponding to ½ of the center wavelength $\lambda_{g2}$ of the band desired to be rejected. The spiral slot 15 functions to resonate and prevents frequency signals desired to be rejected from being transferred from the feeding unit 11 to the radiating unit 20. Referring to the equivalent diagram shown in FIG. 3, the input impedance $Z_{in}^S$ of the spiral slot 15 may be represented by the following Equation (2):

$$Z_{in}^S = jZ_O^S \tan \beta_s L_{s2} \quad (2)$$

where $Z_{in}^S$ the input impedance of the spiral slot 15, $Z_O^S$ denotes the characteristic impedance of the spiral slot 15, $L_{s2}$ denotes the length of the spiral slot 15, $\beta_s$ denotes the propagation constant of the spiral slot 15, and $\lambda_{g2}$ denotes the guide wavelength of the spiral slot 15.

Therefore, if the length $L_{s2}$ of the spiral slot 15 becomes the half wavelength of stop band frequencies ($L_{s2}=\lambda_{g2}/2$), the input impedance $Z_{in}^S$ of the spiral slot 15 becomes '0', and then the spiral slot 15 enters a shorted state ($\beta_s=2\pi/\lambda_{g2}$). That is, the signals corresponding to stop band frequencies are stopped via the spiral slot 15. By means of this operation, in an embodiment of the present invention, it is most preferable that the length of the spiral slot 15 be ½ of the center wavelength of a stop band desired to be rejected.

Based on the above operating principles, the present invention uses different band-stop elements so as to reject dual-band frequencies, thus effectively controlling the characteristics of the respective bands.

Figure 4:
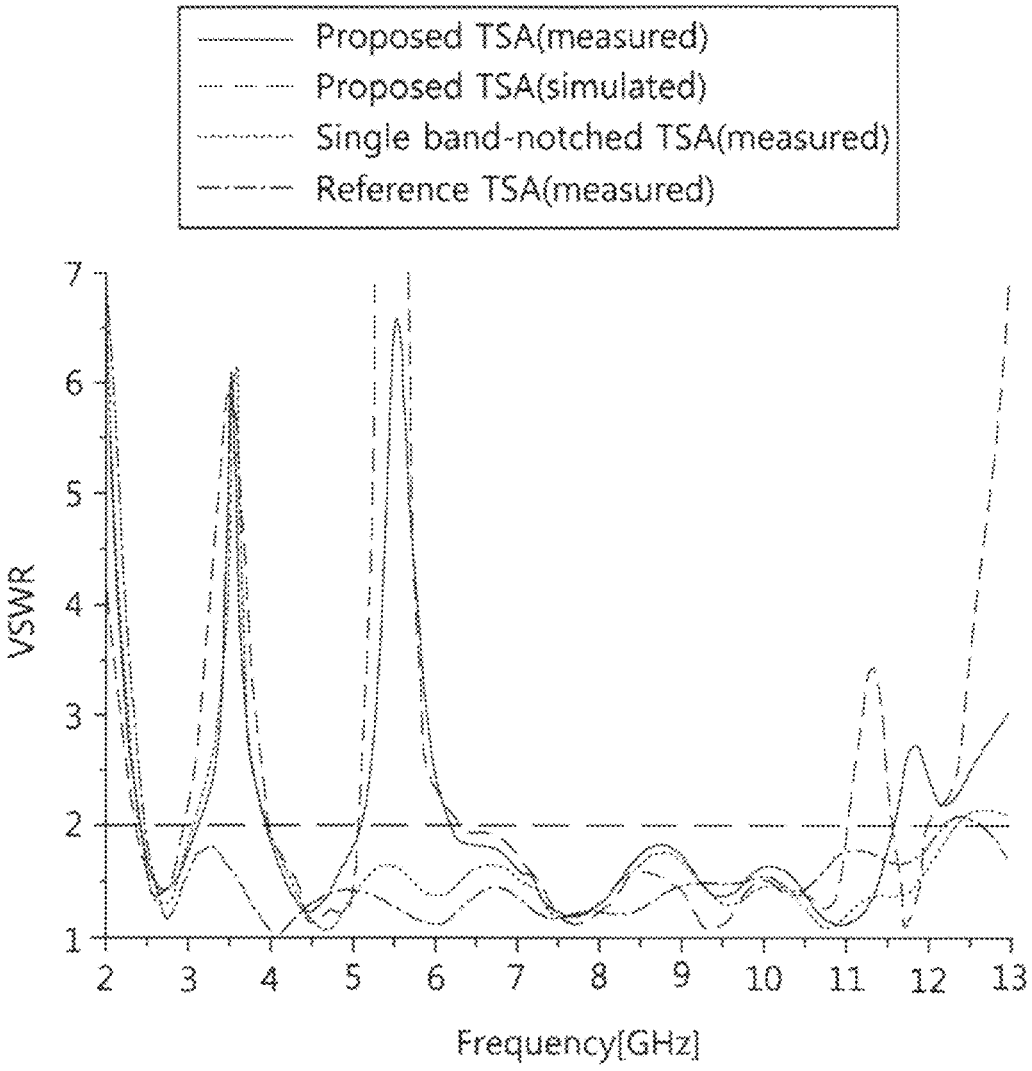
FIG. 4 is a graph showing the comparison of the Voltage Standing Wave Ratio (VSWR) of the ultra-wideband tapered slot antenna according to an embodiment of the present invention.

FIG. 4 is a graph showing the comparison of the Voltage Standing Wave Ratio (VSWR) of the ultra-wideband tapered slot antenna according to an embodiment of the present invention.

The VSWRs of a conventional tapered slot antenna (reference TSA) having no band-stop element and of the ultra-wideband tapered slot antenna (proposed TSA) having dual-band stop characteristics according to an embodiment of the present invention were simulated and measured so as to compare band-stop functions. Further, the VSWR characteristics of an ultra-wideband tapered slot antenna having single-band stop characteristics (single band-notched TSA) in which only C-shaped stubs 13 and 14 are implemented were compared together. Here, the conventional tapered slot antenna having no band-stop element (reference TSA) refers to a TSA equipped with neither the C-shaped stubs 13 and 14 nor the spiral slot 15.

In the ultra-wideband tapered slot antenna according to an embodiment of the present invention, the C-shaped stubs 13 and 14 and the spiral slot 15 are formed, so that it can be seen that band-stop characteristics are obtained in dual bands including a 3.1 to 4.0 GHz band and a 5.1 to 6.2 GHz band. In a frequency band of 2.4 to 11.6 GHz except for the stop band, ultra-wideband characteristics with a VSWR of 2:1 or less are exhibited.

Figure 5:
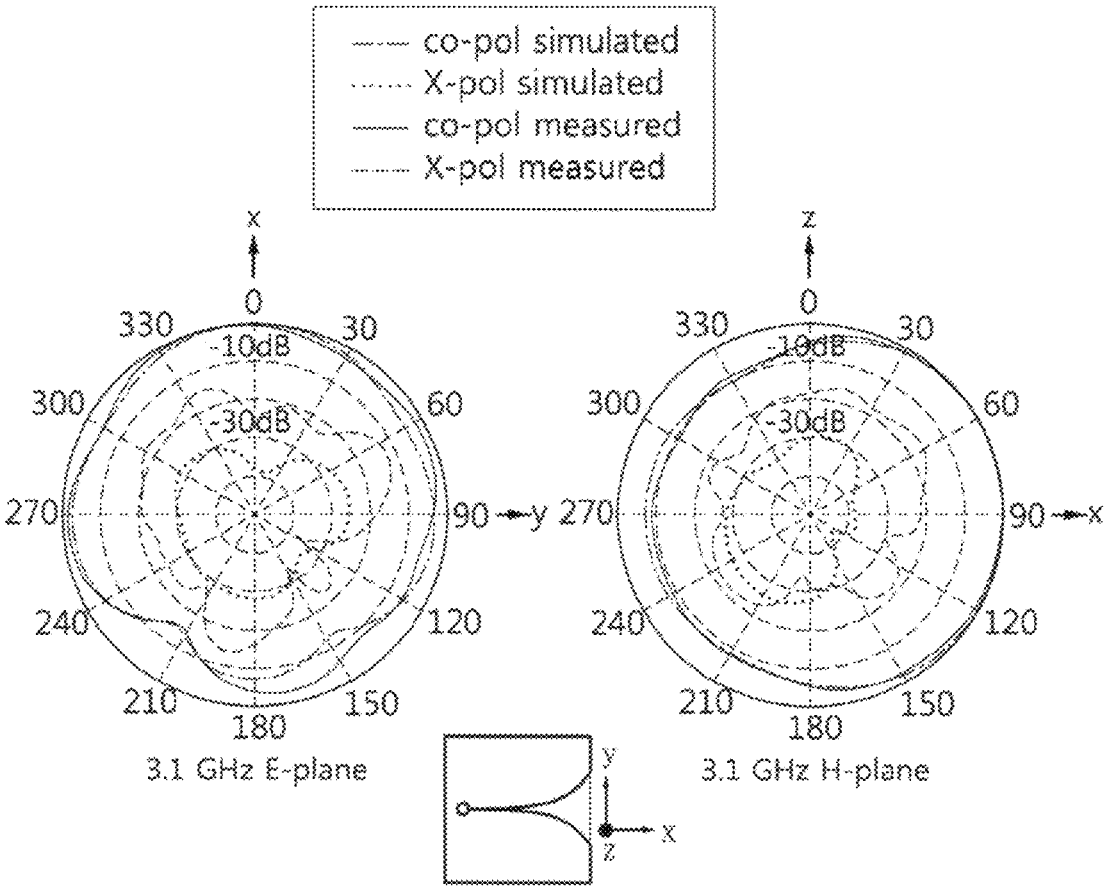
FIGS. 5 to 7 are diagrams showing the radiation patterns of the ultra-wideband tapered slot antenna according to an embodiment of the present invention.
Figure 6:
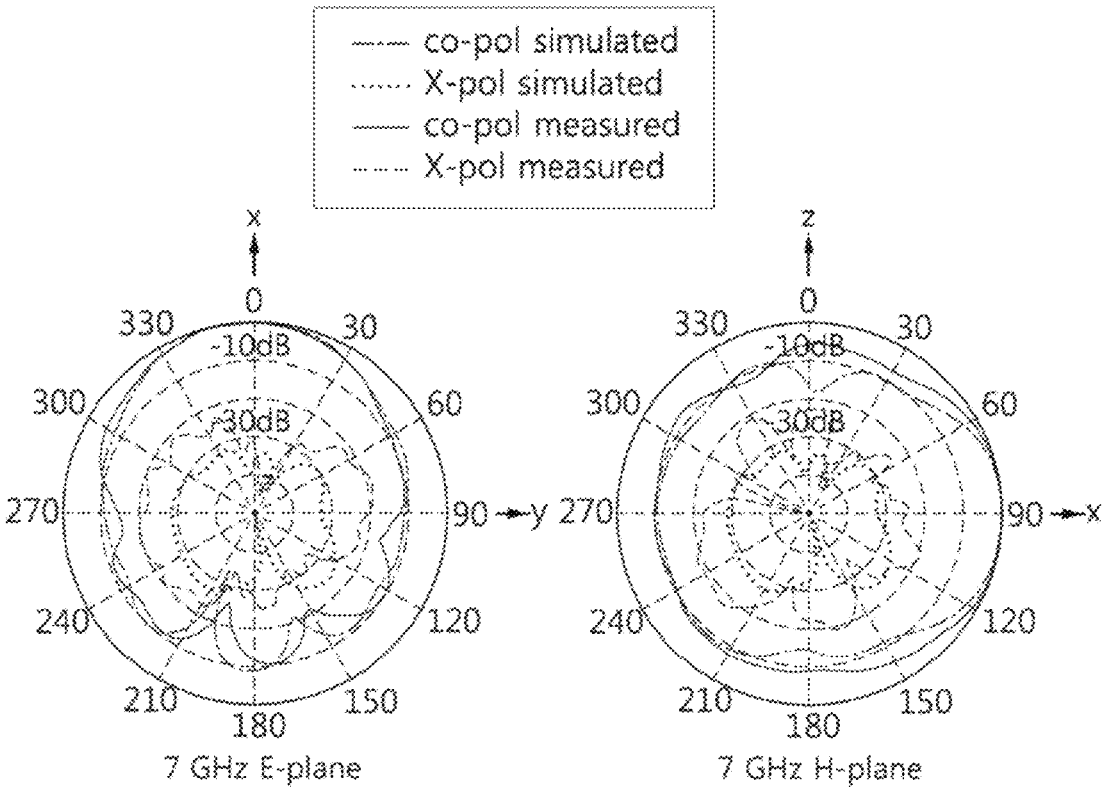
Figure 7:
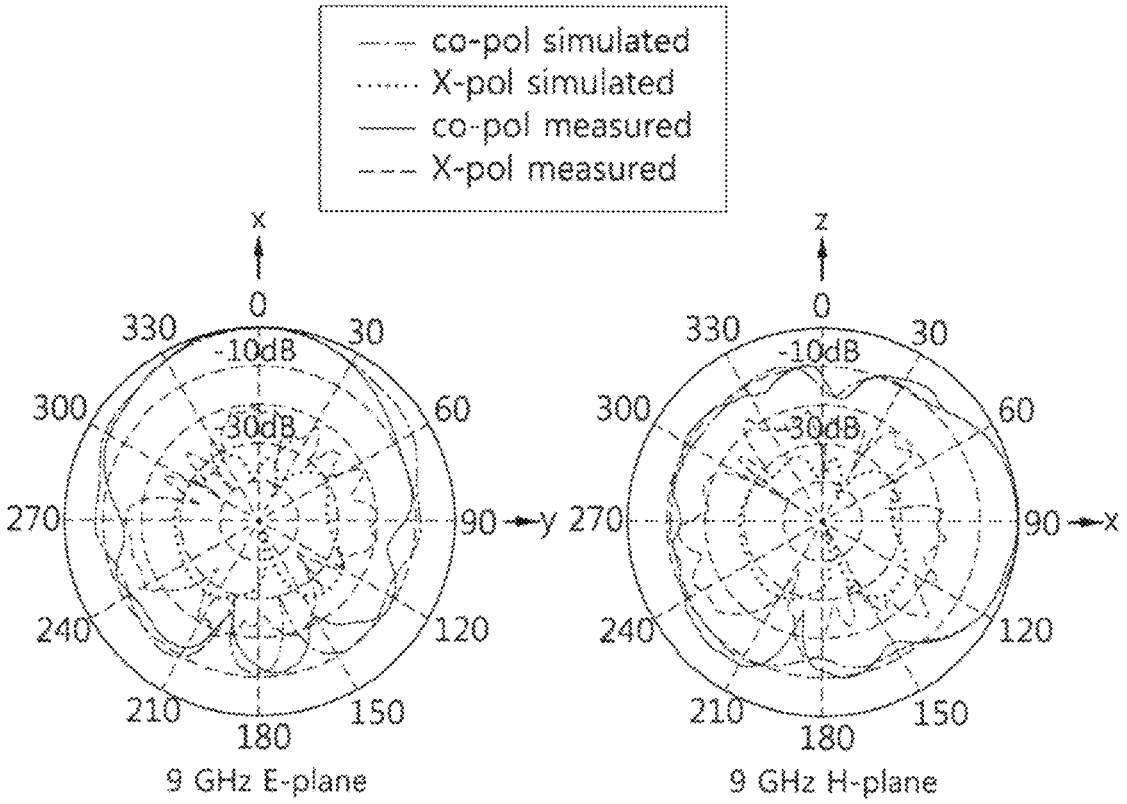

FIGS. 5 to 7 are diagrams showing the radiation patterns of the ultra-wideband tapered slot antenna according to an embodiment of the present invention.

FIG. 5 illustrates the results of simulating and measuring far-field radiation patterns at a frequency of 3.1 GHz on a horizontal plane (xz plane) and a vertical plane (xy plane). FIG. 6 illustrates the results of simulating and measuring far-field radiation patterns at a frequency of 7.0 GHz on a horizontal plane (xz plane) and a vertical plane (xy plane). FIG. 7 illustrates the results of simulating and measuring far-field radiation patterns at a frequency of 9.0 GHz on a horizontal plane (xz plane) and a vertical plane (xy plane).

FIGS. 5 to 7 illustrate directional patterns in operation frequency bands. In particular, the drawings exhibit stabilized radiation patterns in which the intensity of cross-polarization in a radiation direction (direction of positive (+) x axis) is lower than that of co-polarization by 20 dB or more.

Figure 8:
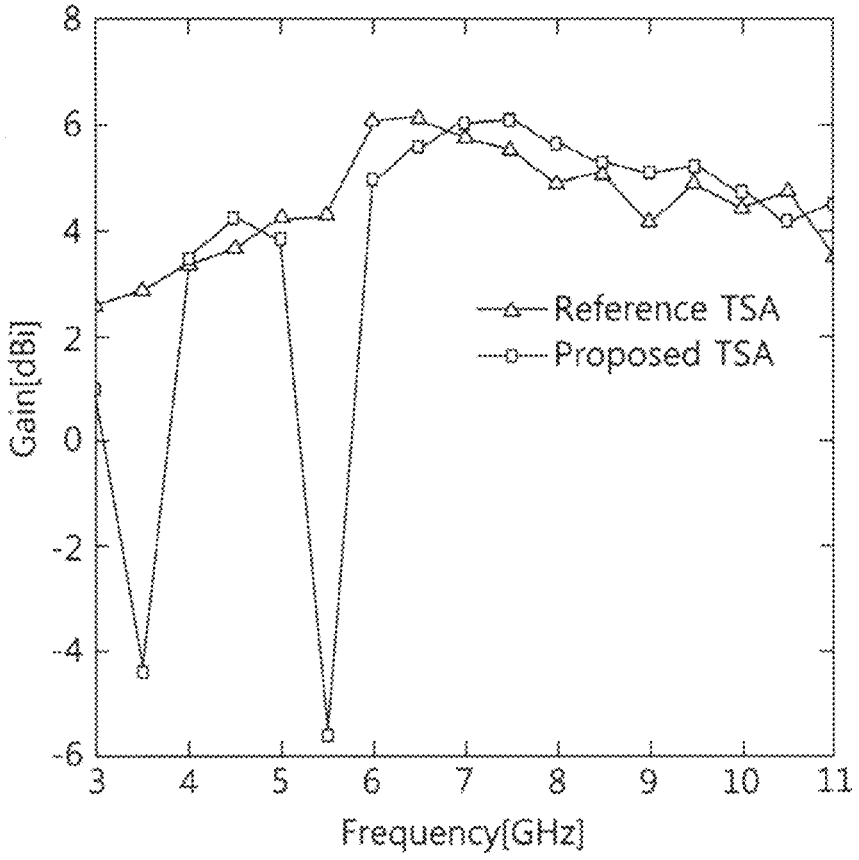
FIG. 8 is a graph showing the measurement and comparison of gain of the ultra-wideband tapered slot antenna according to an embodiment of the present invention.

FIG. 8 is a graph showing the measurement and comparison of the gain of the ultra-wideband tapered slot antenna according to an embodiment of the present invention.

As shown in FIG. 8, the forms of gain for respective frequencies similar to those of a conventional tapered slot antenna (reference TSA) in a 3 to 11 GHz band, wherein the gain ranges from 1.1 to 6.1 dBi. However, in stop bands corresponding to 3.5 GHz and 5.5 GHz, the gain levels of the ultra-wideband tapered slot antenna exhibit −4.3 dBi and −5.6 dBi, respectively, and thus the band-stop characteristics are verified.

Figure 9A:
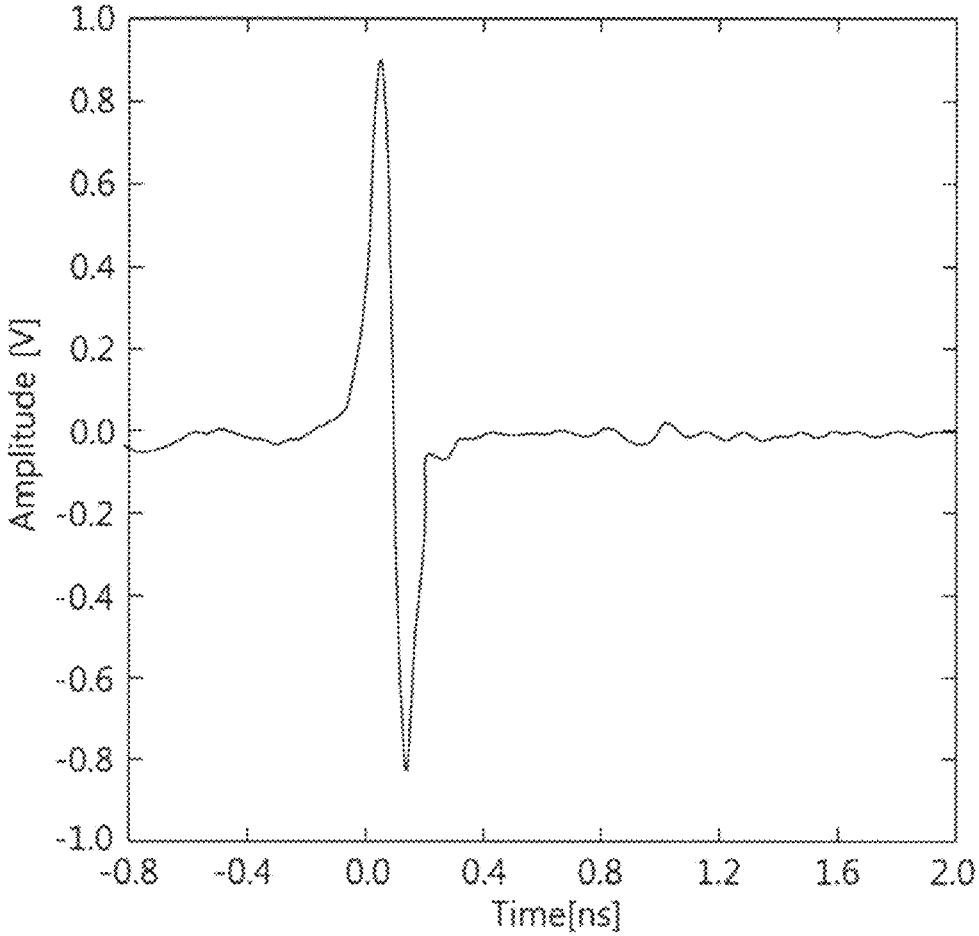
FIGS. 9A and 9B are graphs showing the measurement and comparison of impulse response characteristics of the ultra-wideband tapered slot antenna according to an embodiment of the present invention.
Figure 9B:
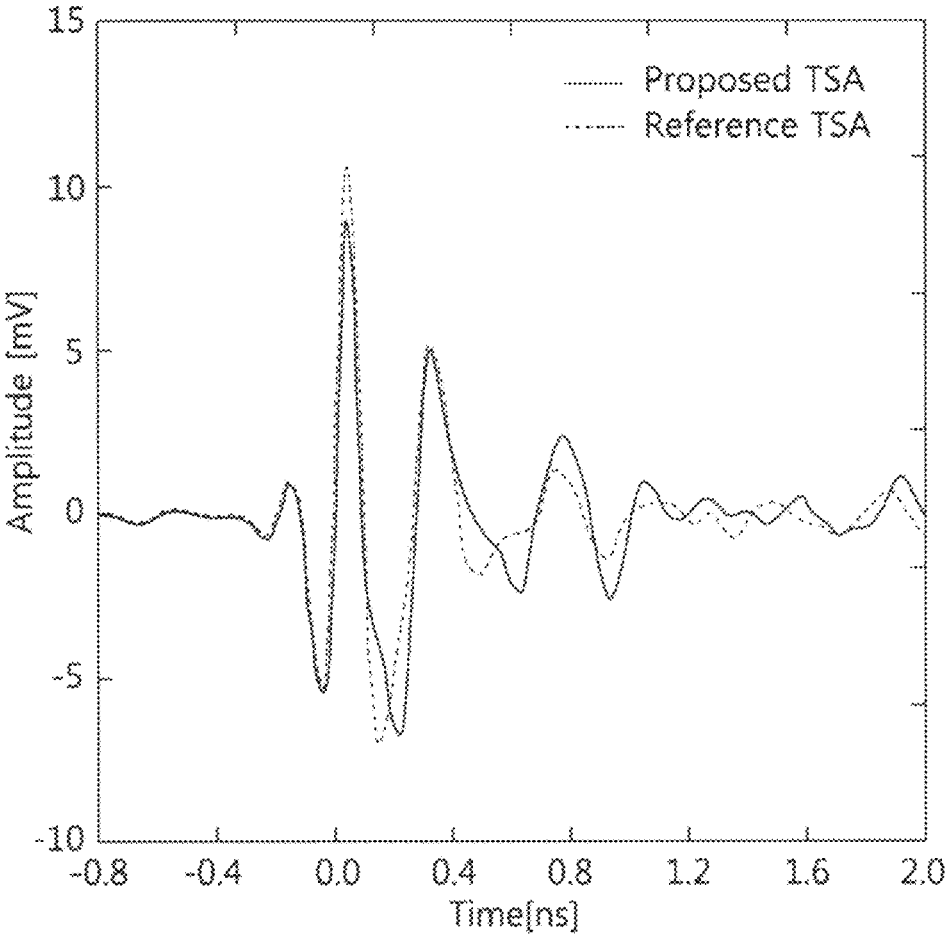

FIGS. 9A and 9B are graphs showing the measurement and comparison of impulse response characteristics of the ultra-wideband tapered slot antenna according to an embodiment of the present invention.

FIG. 9A is a graph showing the waveform of a transmission pulse transmitted by a transmitter (not shown), and FIG. 9B is a graph showing the comparison between the waveforms of reception pulses received by the ultra-wideband tapered slot antenna according to the embodiment of the present invention and by a conventional tapered slot antenna (reference TSA) for the transmission pulse transmitted by the transmitter. Here, the conventional tapered slot antenna (reference TSA) denotes a TSA equipped with neither the C-shaped stubs 13 and 14 nor the spiral slot 15. At this time, a separation distance between a transmitting antenna and a receiving antenna (that is, the ultra-wideband tapered slot antenna according to the embodiment of the present invention or the conventional tapered slot antenna (reference TSA)) is set to 1 m.

As shown in FIG. 9B, it can be seen that, even if the ultra-wideband tapered slot antenna according to the embodiment of the present invention has a dual band-stop element (that is, the C-shaped stubs 13 and 14 and the spiral slot 15), the reception waveforms thereof are almost identical to those of the conventional tapered slot antenna (reference TSA) and then distortion in pulses is scarcely present.

FIGS. 10 to 13 are diagrams showing the simulation of current distributions of the ultra-wideband tapered slot antenna for respective frequencies according to an embodiment of the present invention.

Figure 10:
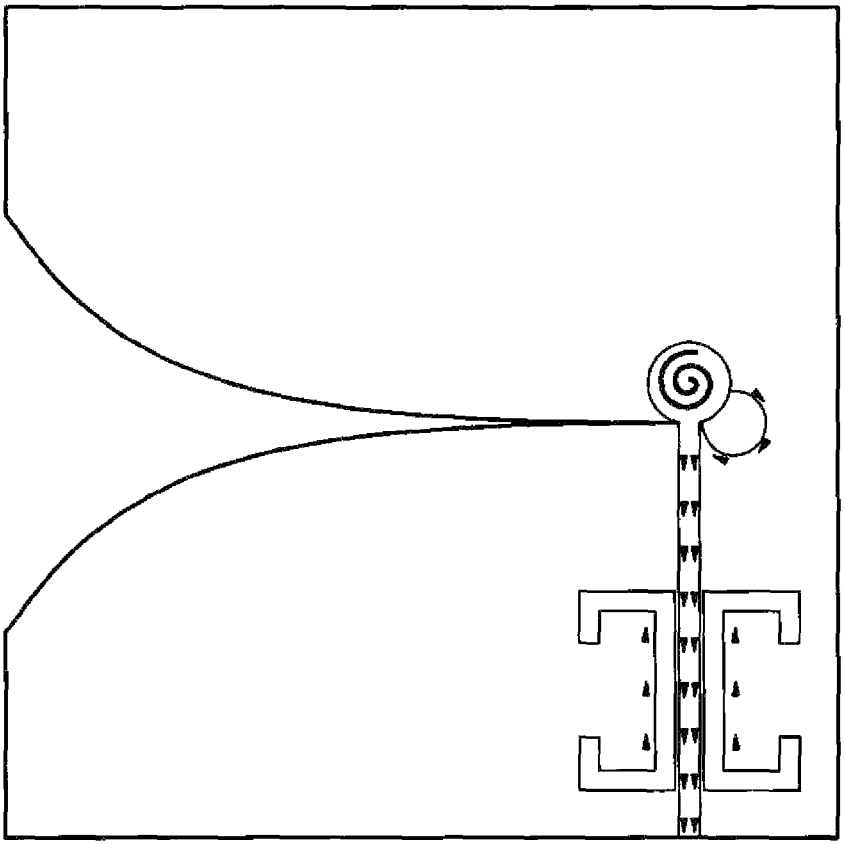
FIGS. 10 to 13 are diagrams showing the simulation of current distributions of the ultra-wideband tapered slot antenna for respective frequencies according to an embodiment of the present invention.
Figure 11:
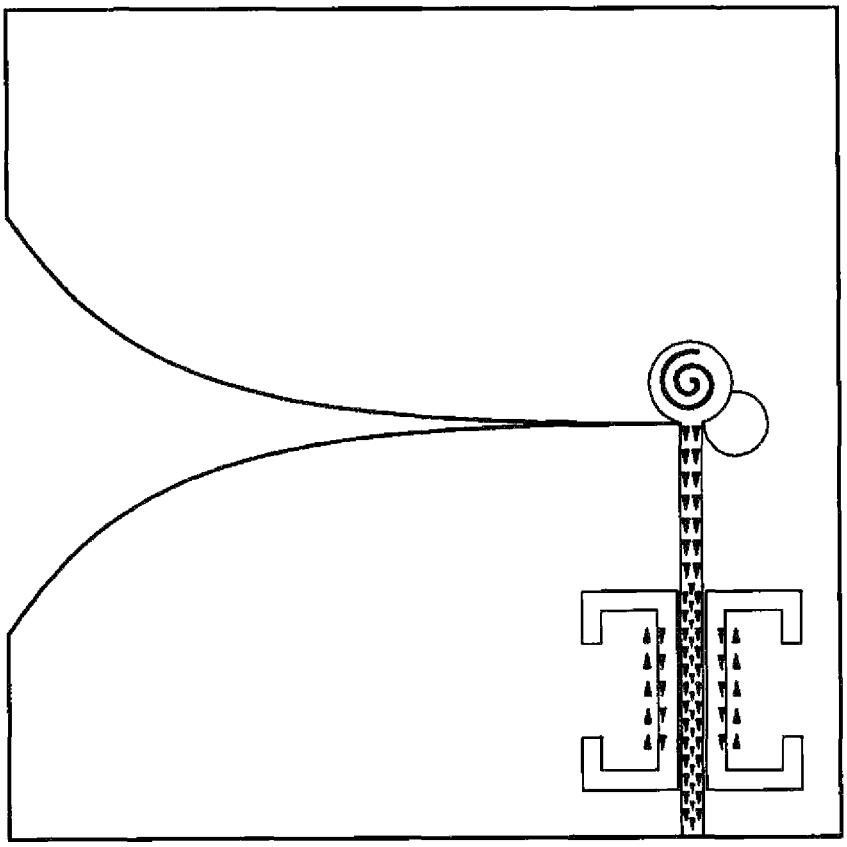
Figure 12:
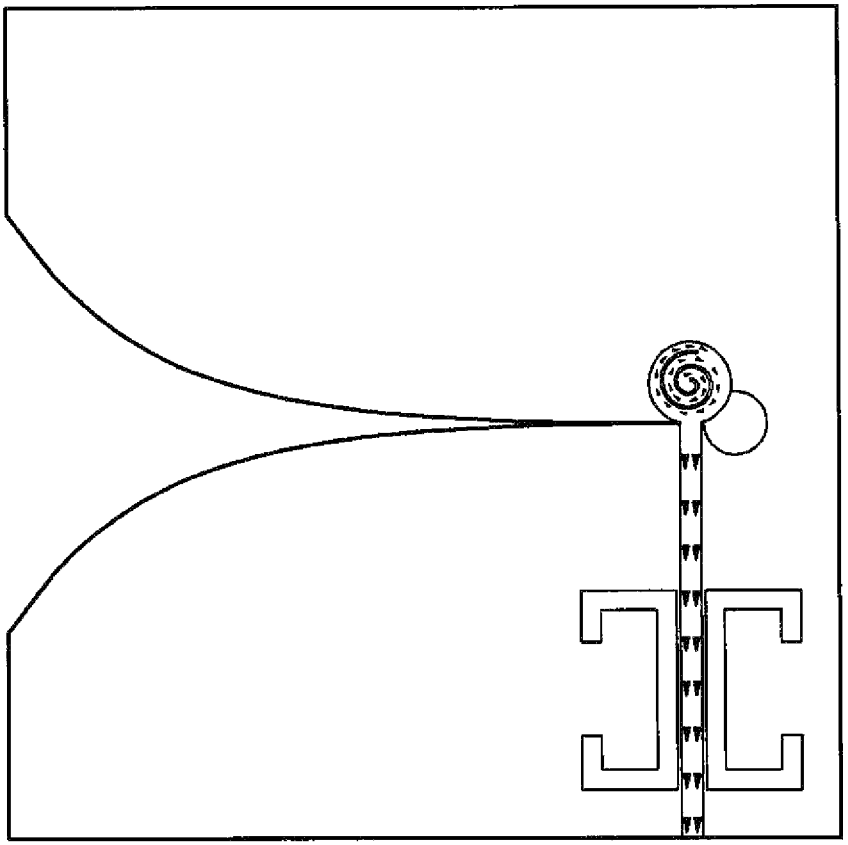
Figure 13:
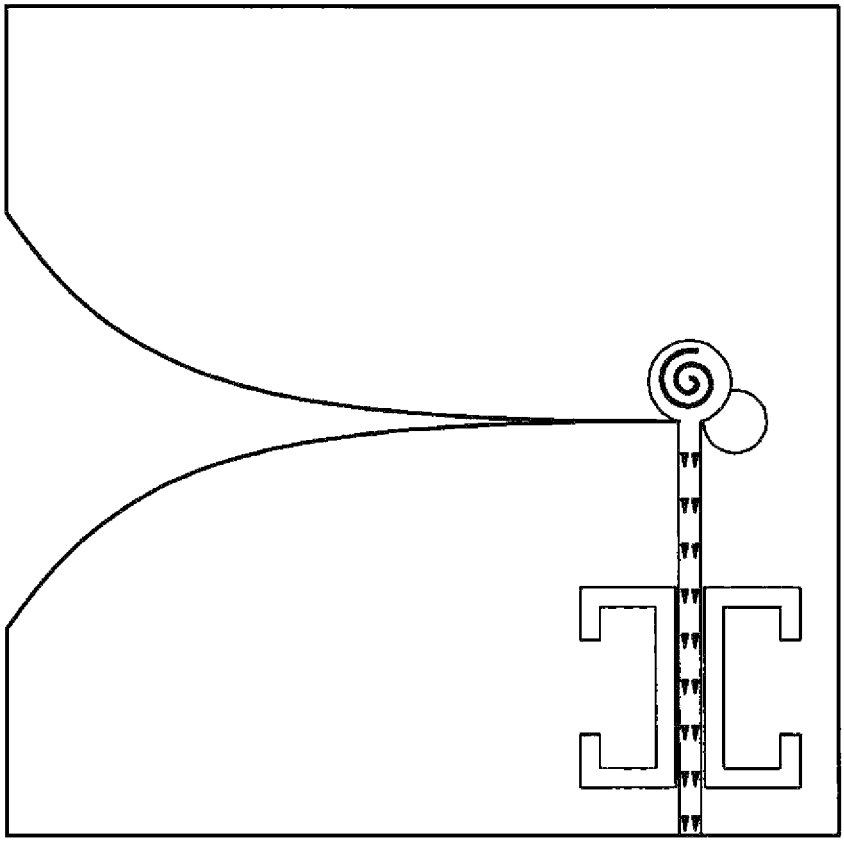

That is, FIG. 10 is a diagram showing the simulation of current distribution of the ultra-wideband tapered slot antenna at a frequency of 3.1 GHz according to an embodiment of the present invention. FIG. 11 is a diagram showing the simulation of current distribution of the ultra-wideband tapered slot antenna at a frequency of 3.5 GHz according to an embodiment of the present invention. FIG. 12 is a diagram showing the simulation of current distribution of the ultra-wideband tapered slot antenna at a frequency of 5.5 GHz according to an embodiment of the present invention. FIG. 13 is a diagram showing the simulation of current distribution of the ultra-wideband tapered slot antenna at a frequency of 9.0 GHz according to an embodiment of the present invention.

Compared to the current distribution of operation bands of 3.1 GHz and 9.0 GHz, it can be seen that the current distribution in stop bands of 3.5 GHz and 5.5 GHz greatly increases on respective stop-band elements, that is, the C-shaped stubs 13 and 14 and the spiral slot 15. This means that the stop-band elements resonate at the respective stop-band frequencies.

Figure 14:
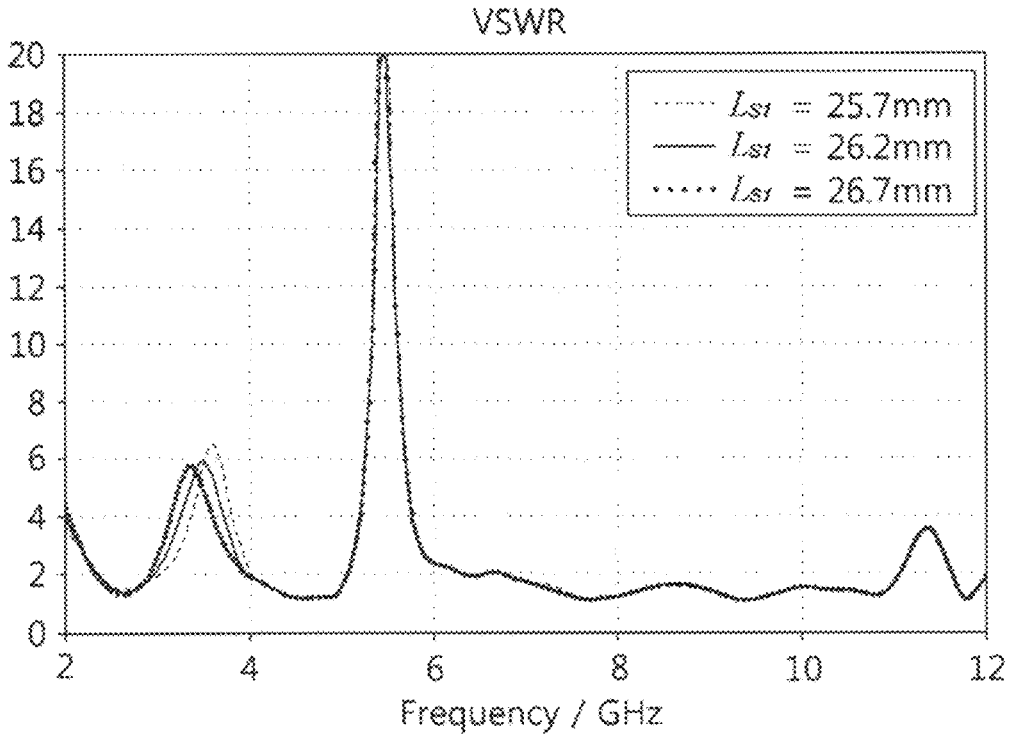
FIG. 14 is a graph showing the comparison of VSWRs of the ultra-wideband tapered slot antenna depending on the values of parameter $L_{s1}$.

FIG. 14 is a graph showing the comparison between the VSWRs of the ultra-wideband tapered slot antenna depending on the values of parameter $L_{s1}$. That is, FIG. 14 is a graph showing the VSWRs of the ultra-wideband tapered slot antenna depending on the variations in the length $L_{s1}$ of the C-shaped stubs 13 and 14.

In order to control the center frequency of a stop band, VSWR for the parameter $L_{s1}$ shown in FIG. 1 was simulated.

As shown in FIG. 14, the center frequency of the stop band is lowered by increasing the length $L_{s1}$ of the C-shaped stubs 13 and 14.

Figure 15:
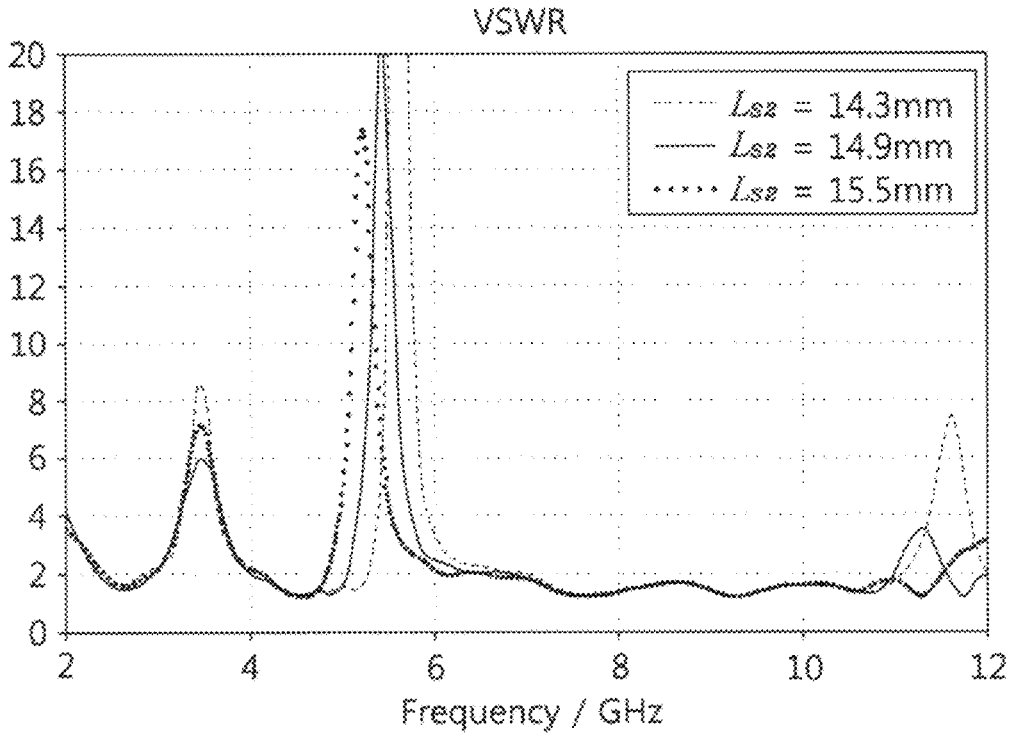
FIG. 15 is a graph showing the comparison of VSWRs of the ultra-wideband tapered slot antenna depending on the values of parameter $L_{s2}$.

FIG. 15 is a graph showing the comparison between the VSWRs of the ultra-wideband tapered slot antenna depending on the values of parameter $L_{s2}$. That is, FIG. 15 is a graph showing the VSWRs of the ultra-wideband tapered slot antenna depending on the variations in the length $L_{s2}$ of the spiral slot 15.

In order to control the center frequency of the stop band, the VSWR for the parameter $L_{s2}$ shown in FIG. 1 was simulated.

As shown in FIG. 15, the center frequency of the stop band is lowered by increasing the length $L_{s2}$ of the spiral slot 15.

Figure 16:
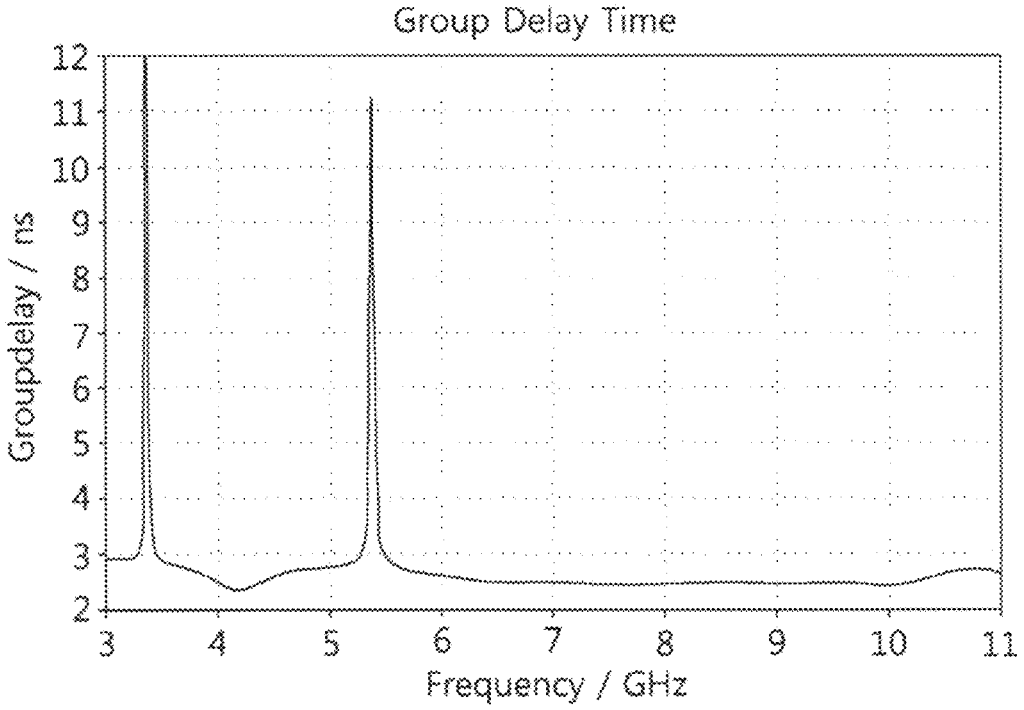
FIG. 16 is a graph showing the group delay characteristics of the ultra-wideband tapered slot antenna for respective frequencies according to an embodiment of the present invention.

FIG. 16 is a graph showing the group delay characteristics of the ultra-wideband tapered slot antenna for respective frequencies according to an embodiment of the present invention.

Referring to FIG. 16, group delay characteristics in an overall frequency band have a variation of 0.56 ns or less with the exception of stop bands. Therefore, the ultra-wideband tapered slot antenna according to the embodiment of the present invention has a minimum distortion in a time response domain.

In accordance with the present invention, there is an advantage in that C-shaped stubs and a spiral slot are simply formed in the feeding unit of a conventional tapered slot antenna, thus enabling an ultra-wideband tapered slot antenna having band-stop characteristics in dual bands (for example, a 3.5 GHz band and a 5.5 GHz band) to be implemented.

Further, the present invention is advantageous in that C-shaped stubs and a spiral slot having a length that is ½ of the wavelength of the center frequency signal of the corresponding stop band are formed in a feeding unit other than a radiating unit, and thus spatial independent band-stop characteristics which are irrelevant to the radiation direction of the antenna in a dual-stop band can be implemented. That is, radio signals corresponding to the resonant frequencies of the C-shaped stubs and the spiral slot among radio signals transferred from the feeding unit to the radiating unit are stopped, thus rejecting signals in specific frequency bands (for example, 3.5/5.5 GHz bands).

Furthermore, the present invention is advantageous in that the antenna can be implemented to obtain response characteristics having a low pulse distortion and the antenna can be simplified and realized to have a small size and light weight, thus enabling mass production at low cost.

As described above, optimal embodiments of the present invention have been disclosed in the drawings and the specification. Although specific terms have been used in the present specification, these are merely intended to describe the present invention and are not intended to limit the meanings thereof or the scope of the present invention described in the accompanying claims. Therefore, those skilled in the art will appreciate that various modifications and other equivalent embodiments are possible from the embodiments. Therefore, the technical scope of the present invention should be defined by the technical spirit of the claims.

What is claimed is:

1. An ultra-wideband tapered slot antenna comprising:

a radiating unit formed on a first surface of a substrate to radiate radio signals;

a feeding unit formed on a second surface of the substrate to provide the radio signals to the radiating unit;

separate stubs formed to be spaced apart from the feeding unit around the feeding unit to reject a first stop band of frequencies from among the radio signals radiated from the radiating unit;

a stub formed at an end of the feeding unit; and a slot formed in the stub formed at the end of the feeding unit to reject a second stop band of frequencies from among the radio signals radiated from the radiating unit.

2. The ultra-wideband tapered slot antenna of claim 1, wherein:

the feeding unit includes a microstrip line, and the separate stubs include a first C-shaped stub and a second C-shaped stub, which are formed at symmetrical locations with respect to the microstrip line.

3. The ultra-wideband tapered slot antenna of claim 2, wherein the first C-shaped stub and the second C-shaped stub have a length that is ½ of a wavelength of a center frequency signal of the first stop band.

4. The ultra-wideband tapered slot antenna of claim 3, wherein the center frequency of the first stop band is controlled by adjusting the length of the first C-shaped stub and the second C-shaped stub.

5. The ultra-wideband tapered slot antenna of claim 4, wherein the center frequency of the first stop band is lowered if the length of the first C-shaped stub and the second C-shaped stub is increased.

6. The ultra-wideband tapered slot antenna of claim 1, wherein the slot is formed in a spiral shape.

7. The ultra-wideband tapered slot antenna of claim 6, wherein the slot has a length that is ½ of a wavelength of a center frequency signal of the second stop band.

8. The ultra-wideband tapered slot antenna of claim 7, wherein the center frequency of the second stop band is controlled by adjusting the length of the slot.

9. The ultra-wideband tapered slot antenna of claim 8, wherein the center frequency of the second stop band is lowered if the length of the slot is increased.

10. The ultra-wideband tapered slot antenna of claim 1, wherein the radiating unit has a tapered slot.

11. The ultra-wideband tapered slot antenna of claim 1, wherein the first stop band is a 3.5 GHz band.

12. The ultra-wideband tapered slot antenna of claim 1, wherein the second stop band is a 5.5 GHz band.

13. An ultra-wideband tapered slot antenna comprising:

a dielectric substrate;

C-shaped first and second separate stubs formed around a feed line on a second surface of the dielectric substrate opposite to a radiating unit formed on a first surface of the dielectric substrate so that the C-shaped first and second separate stubs are spaced apart from the feed line, the C-shaped first and second separate stubs rejecting a first stop band of frequencies from among radio signals radiated from the radiating unit;

a stub formed at an end of the feed line; and a spiral slot formed in the stub formed at the end of the feed line to reject a second stop band of frequencies from among the radio signals radiated from the radiating unit, wherein the first separate stub and the second separate stub have a length that is ½ of a wavelength of a center frequency signal of the first stop band, and wherein the slot has a length that is ½ of a wavelength of a center frequency signal of the second stop band.

* * * * *